United States Patent [19]

Speer

[11] 4,066,025

[45] Jan. 3, 1978

[54] HEM FOLDING MACHINE

[76] Inventor: Billy Logan Speer, P.O. Box 416, Campbellsville, Ky. 42718

[21] Appl. No.: 601,251

[22] Filed: Aug. 4, 1975

[51] Int. Cl.[2] ..... D05B 33/02; D05B 35/02

[52] U.S. Cl. ..... 112/121.29; 112/141; 112/147

[58] Field of Search ..... 112/121.29, 141, 142, 112/143, 153, 152, 147, 121.11, 121.12, 121.15, 203; 270/86, 93, 94

[56] References Cited

U.S. PATENT DOCUMENTS

| | | | |
|---|---|---|---|
| 2,740,457 | 4/1956 | Wood et al. | 112/141 X |
| 3,463,482 | 8/1969 | Baron et al. | 112/147 X |
| 3,481,292 | 12/1969 | Danahy | 112/141 X |
| 3,496,891 | 2/1970 | Kosrow et al. | 112/153 X |
| 3,534,954 | 10/1970 | Lynch | 112/141 X |
| 3,579,876 | 5/1971 | Freermann | 112/153 X |
| 3,850,121 | 11/1974 | Speer | 112/121.29 |
| 3,871,309 | 3/1975 | Frost | 112/121.29 |
| 3,906,877 | 9/1975 | Rockerath et al. | 112/141 |

*Primary Examiner*—H. Hampton Hunter

[57] ABSTRACT

A semi automatic hemming machine for folding cloth pieces with the edge folded back within the fold, stitching the folded cloth pieces to form hems thereon and stacking the stitched hemmed pieces into bundles for further processing. The folding and hemming machine utilizes a conveyor belt for transporting the cloth pieces continuously past stationary folding guide plates and a pair of synchronized narrow belts engage the folded edge of the material, top and bottom, to frictionally drive the folded hem through the folding and stitching operations. A transversely reciprocating stacker with a plurality of fingers for engaging the edge of passing cloth pieces removes the hemmed cloth pieces, drops them onto a stack which is periodically removed for further processing.

22 Claims, 13 Drawing Figures

HEM FOLDING MACHINE

BACKGROUND OF THE INVENTION

The invention relates to a production machine for folding and stitching hems on the edge of cloth pieces and stacking such pieces for further processing in the manufacture of clothing such as men's dress shirts, sleeves, button facings, women's lingerie, infant's wear and like garments. In my prior patent, U.S. Pat. No. 3,850,121, a hemming machine is disclosed which produces a double reverse fold with the use of form plates situated above a conveyor to fold the cloth pieces progressively as they approach the sewing needle with a second conveyor at the sewing needle running at a slightly higher linear speed to engage the folded cloth pieces, to stretch them and remove wrinkles and convey the cloth pieces to an unloading and stacking mechanism which removes them from a conveyor and flips them over onto a stack which can be removed from the machine periodically.

SUMMARY OF THE INVENTION

The present invention differs from my prior hemming machine in providing a different form of hem wherein the edge of the material is tucked or folded within the main fold prior to stitching and is thereby concealed from view on either side, as distinguished from the fold produced by my prior machine wherein the edge of the material resulting from the double reverse fold remains exposed on one side. In order to produce a hem with the edge of the material completely concealed, a different form of guide plate has been employed; and more importantly, a pair of narrow belts synchronized with the main conveyor belt have been adapted to engage upper and lower surfaces of the folded hem to be stitched. The secondary conveyor run at a higher differential speed has been dispensed with. Just prior to stitching, the folded hem is driven by the narrow belts over a gauge strip which can be adjusted in width to produce a uniform desired width of hem.

DESCRIPTION

Figure 1:
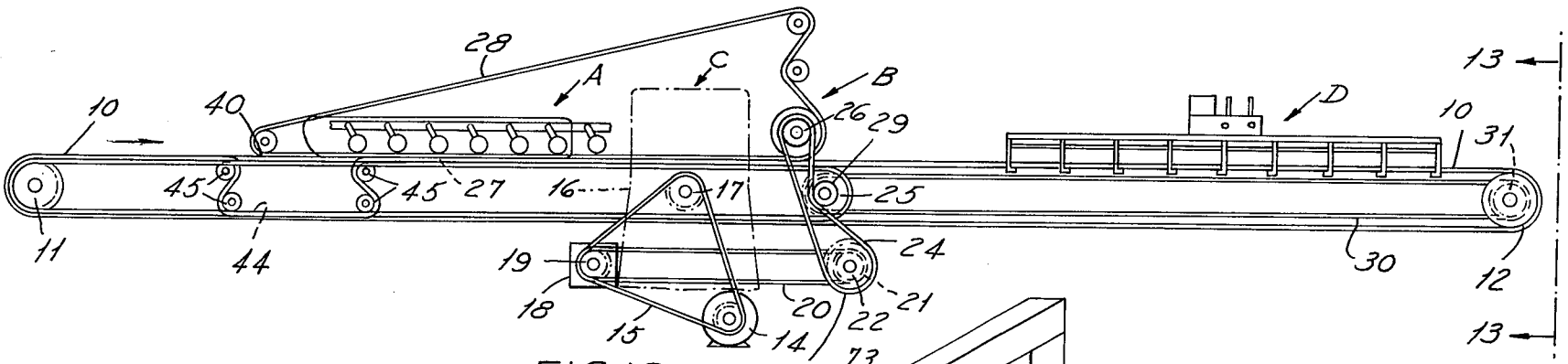
FIG. 1 is a somewhat schematic side elevation of the complete folding, stitching and stacking machine comprising a preferred embodiment of the present invention.
Figure 12:
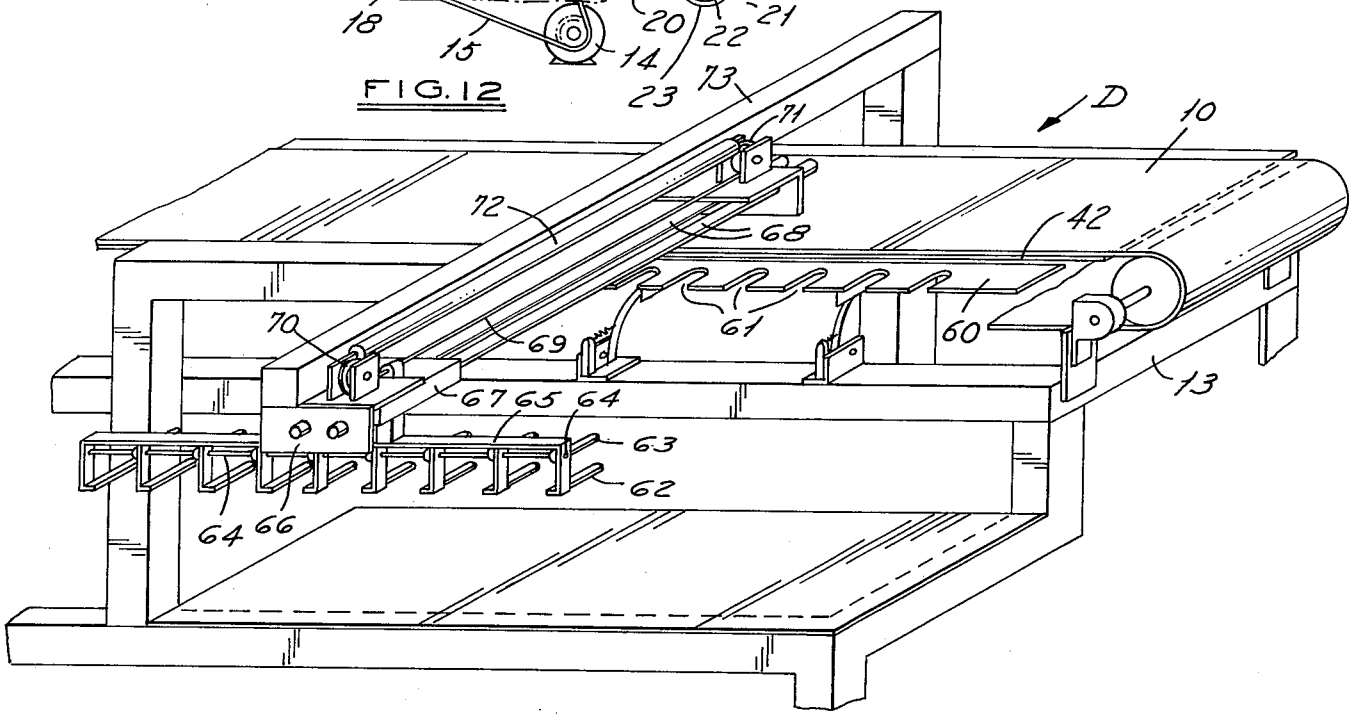
FIG. 12 is a perspective view of the unloading mechanism employed in the stacking operation.
Figure 2:
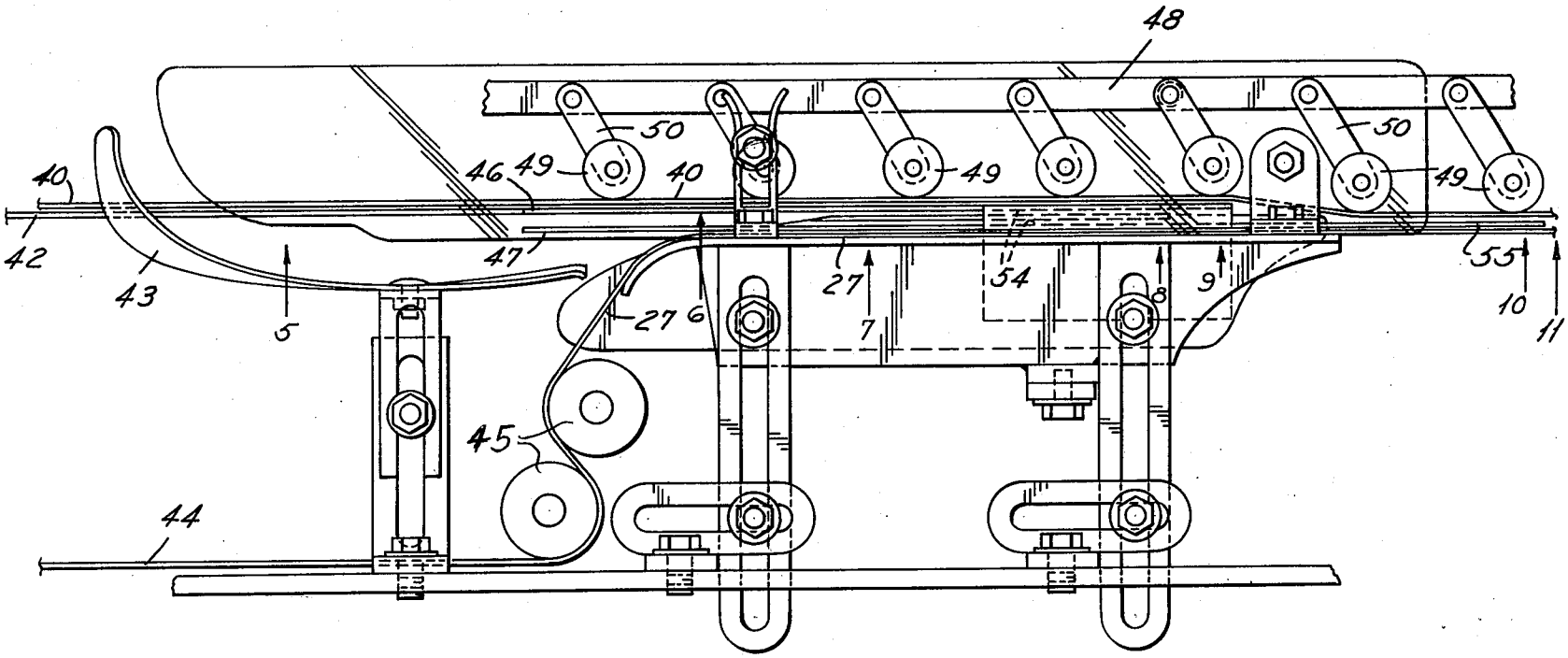
FIG. 2 is an enlarged fragmentary side elevation of the folding and tucking protion of the machine.

Referring to FIG. 1, the machine of the present invention comprises a folder and tucker unit A, a conveyor and hem drive belt system B, a stitcher C and an unloader D. The machine is arranged for manual placement of cloth pieces on a main conveyor belt 10 extending over end belt cylinders 11 and 12 mounted on a suitable machine frame 13, as partially illustrated in FIG. 12. A main drive motor 14 through a V-belt 15 drives a stitcher 16 at a constant speed through a fixed pulley 17 and drives a gear box 18 through a V-pulley 19. The output end of the gear box 18 includes a variable V-pulley, not shown, driving belt 20 and a pulley 21 mounted on a shaft 22 which is coupled to a sprocket 23, driving chain 24, a sprocket 25 and another sprocket 26 which are in turn adapted through drive shafts and pulleys to drive an underlying narrow belt 27 and overlying narrow belt 28 for engaging the hem of material loaded on the main conveyor belt 10. A shaft 29 driven by the sprocket 25 extends to the far side of the conveyor where it drives a sprocket and chain 30 extending to a sprocket 31 at the head end of the conveyor adapted to drive the roller 12 and main conveyor belt 10. With this drive arrangement, both narrow belts 27 and 28, as well as the main conveyor 10, are all driven at synchronous speed from left to right through the folder A and stitcher C after which the conveyor belt 10 continues to carry the material to the unloader D.

Figure 3:
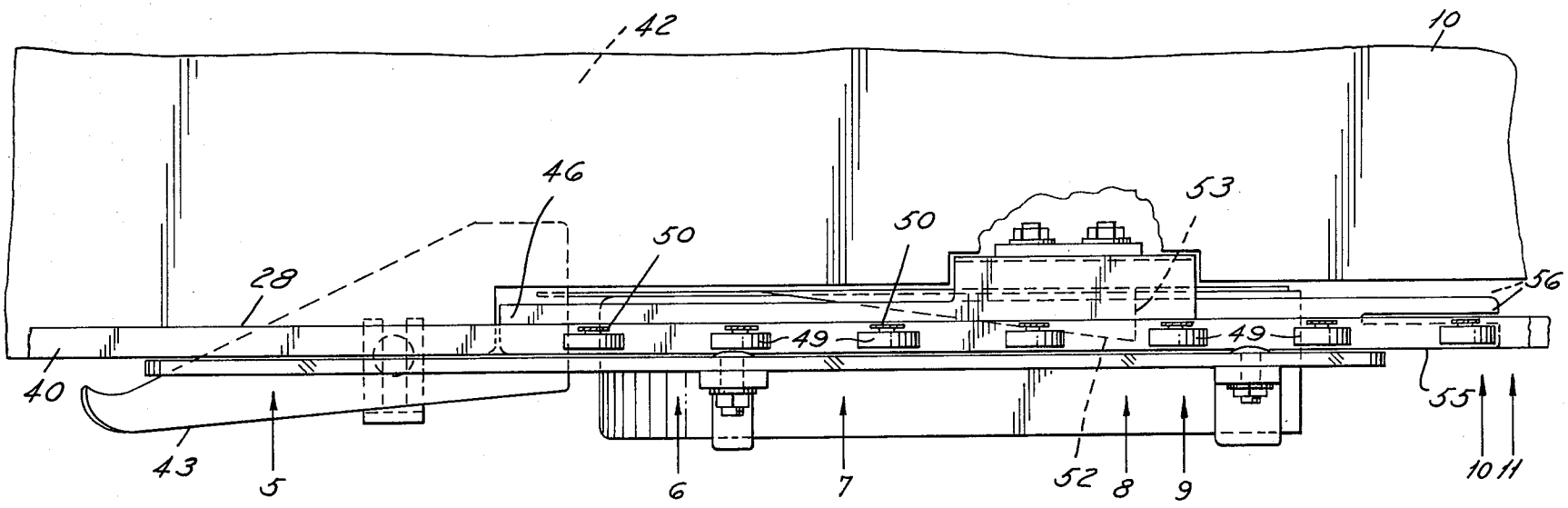
FIG. 3 is an enlarged fragmentary plan view of the portion of the machine shown in FIG. 2.
Figure 4:
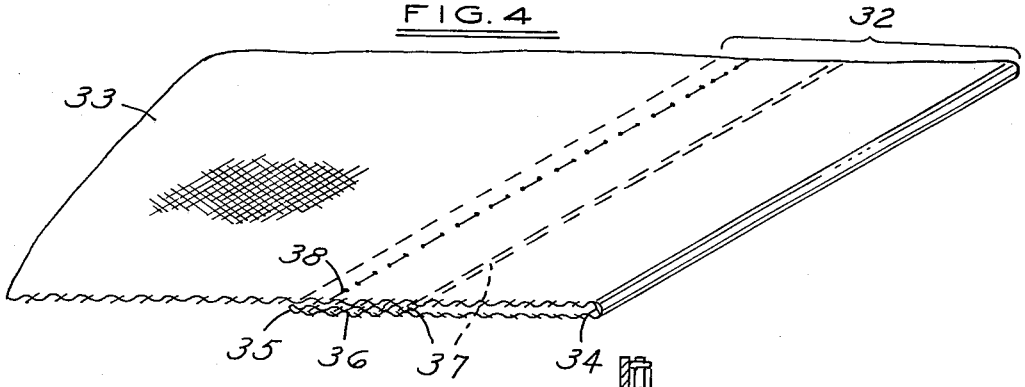
FIG. 4 is a perspective view of a completed hem produced on the machine of the present invention.

The operation of the folder and tucker A may best be understood with reference to the enlarged fragmentary side elevation and plan views of FIGS. 3 and 4, as well as the sequential views of FIGS. 5 through 11. The finished hem of the machine, as illustrated in FIG. 4, is produced along one side 32 of a material panel 33 and includes a first fold 34, a second fold 35, and a tucked in short portion of material 36 having its edge 37 inside the stitch line 38.

Figure 5:
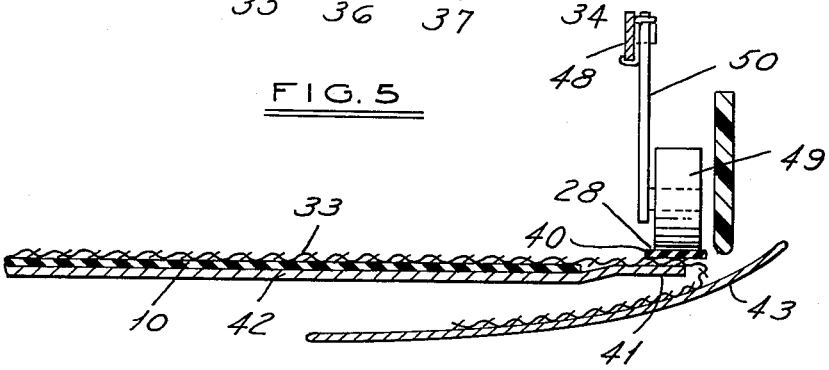
FIGS. 5 through 10 are successive fragmentary sectional end views of successive stages of the folding operation in passing through the portion of the machine shown in FIGS. 2 and 3 and taken along lines correspondingly numbered 5–10.

With reference to FIG. 1, a panel of material to be hemmed is manually laid on the conveyor 10 at the left hand end with the margin of the material to be hemmed overlying the edge of the conveyor by a suitable amount sufficient to form the complete hem. As the panel advances from left to right, its leading edge is first engaged by the end 40 by the overlying narrow belt 28 which is located immediately above the marginal edge 41 of a track plate 42 on which the conveyor belt 10 is supported so that, as shown in FIG. 5, the material panel 33 is driven from the underside by the main conveyor belt 10 and from the top by the narrow belt 28 along the marginal edge 41 of the plate 42. The leading edge of the material next engages a curved guide 43 which leads the material to a folded-under position, as shown in FIG. 5, preparatory to its engagement from underneath by the lower narrow belt 27 which is led to a lower clearance level 44 by four idler rollers 45 to provide an open space for the material to be folded under by the guide 43, as best shown in FIGS. 1, 2, 3 and 5.

Figure 6:
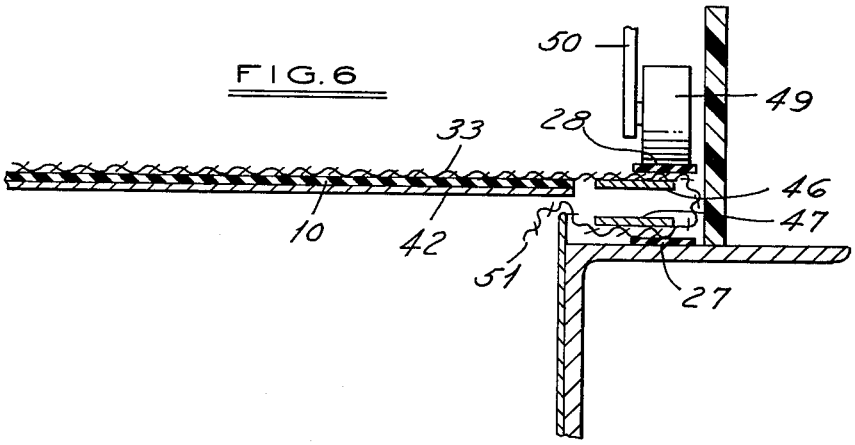

With reference to FIGS. 2, 5, 6 and 7, an upper fixed guide rail 46 and substantially spaced lower fixed guide rail 47 project along the edge of the conveyor throughout a section extending under an overlying bar 48 on which a series of gravity actuated rollers 49 are pivotally suspended through linkage arms 50. The material 33, after being initially folded, as shown in FIG. 5, passes around the spacing guide rails 46 and 47 and the lower surface of the material is engaged by the lower narrow guide belt 27, as shown in FIG. 6, so that the spaced hem portions of the material are frictionally driven under effective control by the narrow lower belt 27 as well as the upper narrow belt 28 urged against the material by the series of weighted rollers 49.

Figure 7:
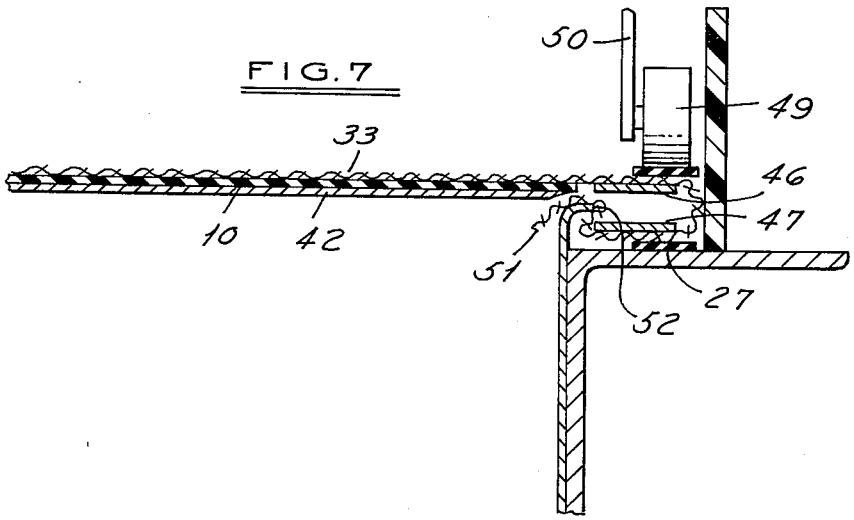
Figure 8:
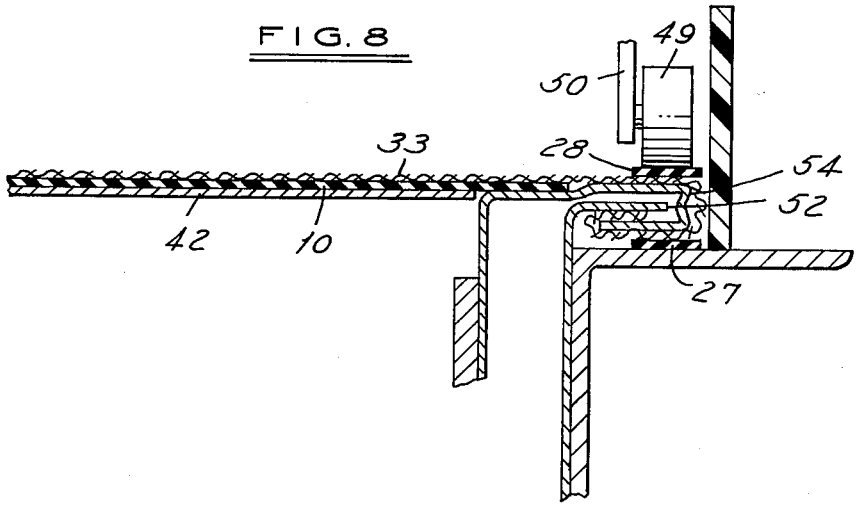

As the folded hem progresses, its edge 51 is folded back and tucked within the spacer guide rails 46, 47 by the edge of a guide flange 52, as shown in FIGS. 7 and 8. Such guide flange terminates at edge 53, as shown in FIG. 3, leaving the material folded and tucked, as shown in FIG. 9

Figure 9:
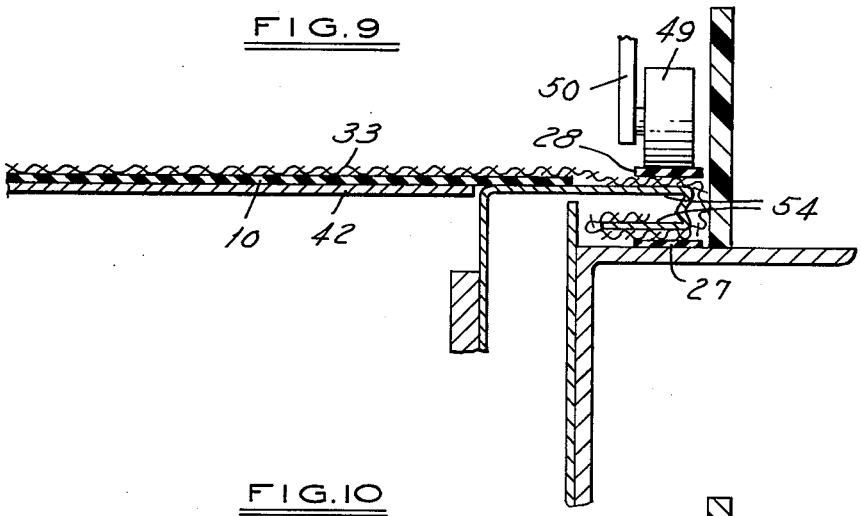
Figure 10:
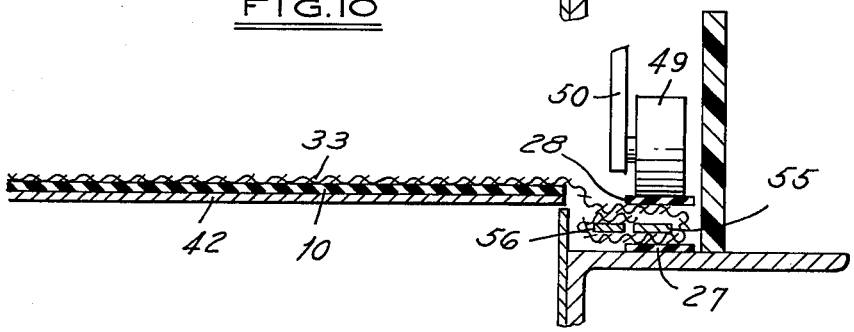
Figure 11:
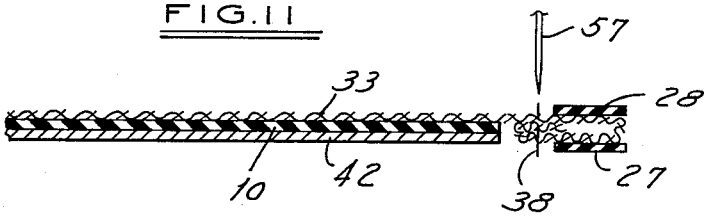
FIG. 11 is a fragmentary schematic sectional end view illustrating the relationship of the needle in passing the hem through the stitcher, taken along the line 11 shown in FIGS. 2 and 3.

Extending in region of FIGS. 8 and 9, an integral U-shaped channel 54 serves as a mounting for the rearwardly projecting guide rails 46 and 47, as well as a forwardly projecting extension of the roller guide rail 47 divided into two spaced extensions 55 and 56 which may be sprung apart adjustably to provide the final desired width of hem, as best shown in FIGS. 3 and 10. Immediately after passing the terminal ends of such extensions, the hem material continues to be driven by engagement with the upper and lower narrow belts 27, 28 through the stitcher C where a sewing needle 57 stitches the hem along the line 38, as shown in FIGS. 4 and 11.

The material pieces 33 with the stitched hems projecting over the edge are conveyed by belt 10 to the unloading station D where the hemmed material passes over a stationary side plate 60 having a plurality of slotted recesses 61 which are aligned with a corresponding number of fixed lower and movable upper material engaging fingers 62 and 63 of the unloading mechanism. The upper fingers 63 are mounted on a common pivoted actuating rod 64 suspended from a frame 65, in turn mounted on a plate 66 having an extension 67 engaging a pair of guide rods 68 for reciprocation through a drive cable 69 passing over pulleys 70, 71 and actuated through a power cylinder 72 suitably mounted on a stationary frame 73.

Figure 13:
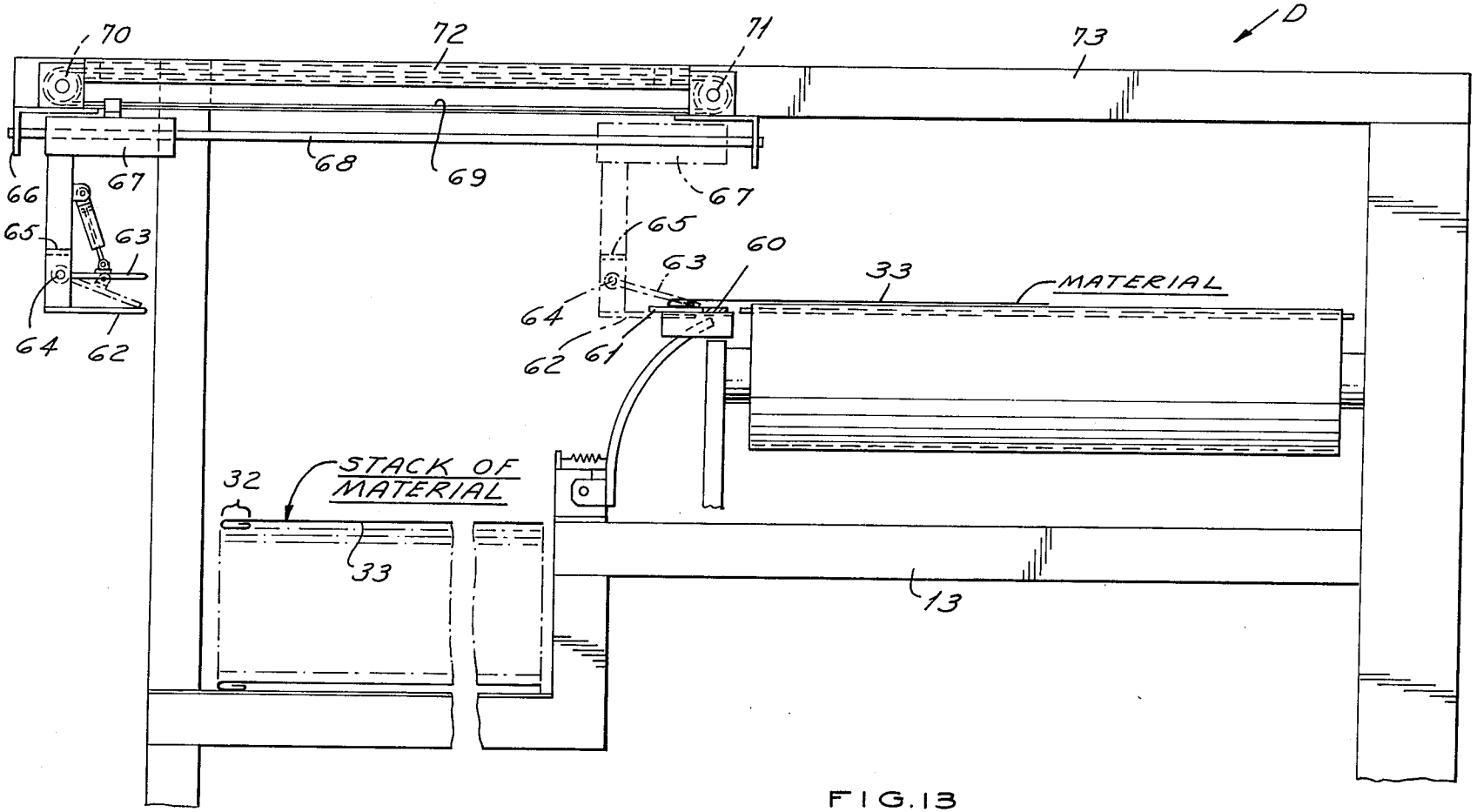
FIG. 13 is an enlarged end elevation of the unloader taken along the line 13—13 of FIG. 1.

The power cylinder 72 is adapted to actuate the unloading mechanism to an inner pick-up position where the fingers 62 and 63 extend above and below the hemmed material passing over the slotted apertures 61, at which time actuation of the upper fingers 63, by a suitable power and linkage means as shown in FIG. 13, provides finger engagement of the moving material for unloading retraction from the conveyor belt 10. During the retraction travel, the upper fingers 63 are actuated to release the material onto a stack, as shown in FIG. 13, which may be periodically removed by manual or other means not shown.

I claim:

1. A hemming machine comprising conveyor means to continuously convey successive pieces of cloth, progressive folding, tucking and sewing means adjacent said conveyor means adapted to fold and tuck within the fold an edge of each cloth piece preparatory to sewing, said folding and tucking means including spaced guide rails for maintaining a spaced relation between adjacent layers of the hem material and supplemental tapered guide means extending between said spaced guide means for engaging, folding back and tucking the cloth edge between said adjacent layers, and hem engaging conveying means supplemental to and synchronized for movement with the first mentioned conveyor for continuously drivingly engaging opposite outside surfaces of the hem portion of said cloth pieces during passage through said progressive folding, tucking and sewing means, said hem engaging conveying means including means adjacent the outside surface of each of said guide rails and cooperating with said surface to feed each of said outside hem portion surfaces therebetween.

2. A hemming machine as set forth in claim 1 including narrow endless belt means employed as said supplemental hem engaging means.

3. A hemming machine as set forth in claim 2 including upper and lower narrow belt means for engaging the outer extremities of the folded hem material.

4. A hemming machine as set forth in claim 3 including track means for supporting the lower of said narrow belts and pressure applying means for urging the upper of said narrow belts against said hem material.

5. A hemming machine as set forth in claim 4 wherein said pressure means comprise a plurality of gravity actuated rollers and engaging said upper narrow belt means.

6. A hemming machine as set forth in claim 1 including an extension of one of said spaced guide means for establishing the width of hem immediately in advance of the sewing station 7. A hemming machine as set forth in claim 1 with a track plate provided for loading of said successive pieces of cloth with the hemmed material overhanging said conveyor and track plate on one side.

8. A hemming machine as set forth in claim 7 wherein said hem engaging means includes an upper endless belt means to engaging the upper layer of hem material adjacent said overhanging edge at the beginning of said progressive folding, tucking and sewing means.

9. A hemming machine as set forth in claim 8, including curved guide means extending under said belt means in spaced relation adapted to intercept the leading edge of each passing cloth piece and to fold it under said conveyor and belt means.

10. A hemming machine as set forth in claim 9, wherein said curved guide means extends under said spaced guide means.

11. A hemming machine as set forth in claim 10, wherein said hem engaging means includes a lower endless belt means extending past a terminal end of said curved guide means to engage the underside of the lower layer of said folded hem material to provide in combination with said upper belt means upper and lower frictional drive of said hem material along the outer surfaces of said spaced guide means.

12. A hemming machine as set forth in claim 11 including a support track underlying said lower belt means.

13. A hemming machine as set forth in claim 12, wherein said supplemental tapered guide means terminates at a position where said cloth edge has been completely tucked within said spaced layers of hemmed material.

14. A hemming machine as set forth in claim 13, wherein one of said spaced guide means extends at its terminal end to a pair of laterally variable spaced guides adjustably adapted to establish the finished width of hem.

15. A hemming machine as set forth in claim 14, wherein said upper and lower belt means continue to engage said hemmed material beyond the terminal ends of said respective guide means and past the stitching needle of said stitching means.

16. A hemming machine as set forth in claim 1 wherein said conveyor means extends beyond said stitching means to an unloader station.

17. A hemming machine as set forth in claim 16, wherein a slotted plate is provided at said unloading station which is overpassed by the hemmed edge of said cloth pieces.

18. A hemming machine as set forth in claim 17, wherein an unloading mechanism is provided at said unloading station adapted to engage said hemmed material as it passes over said slotted plate and to automatically pull successive individual cloth pieces off said conveyor means.

19. A hemming machine as set forth in claim 18, wherein said unloading mechanism is provided with a plurality of cloth engaging fingers mounted on a common pivoted actuating rod and a plurality of corresponding cooperating unpivoted cloth engaging fingers alignable with the slots in said slotted plate.

20. A hemming machine as set forth in claim 19 wherein said unloading mechanism includes reciprocating means for moving said fingers to a material engaging position and to retract said cloth pieces to an unloaded position.

21. A hemming machine as set forth in claim 20 including rod actuating means adapted to close said fingers in engaging the material and to release said material onto a stack at an unloaded position.

22. A hemming machine as set forth in claim 21 wherein said unloading mechanism is adapted to operate through a cycle including means to advance with fingers open to a slot aligned position, means for closing the fingers to engage the hemmed material as it overpasses said slotted plate, means for retraction of the closed fingers to a position overlying the stack of material, means for opening of said fingers to release said hemmed material, and means for completion of the retraction movement of said fingers.

* * * * *